US006481443B1

(12) United States Patent
Moore-Johnson et al.

(10) Patent No.: US 6,481,443 B1
(45) Date of Patent: Nov. 19, 2002

(54) POLISH REMOVER PAD HAVING PROTECTIVE RIM

(76) Inventors: Misty Moore-Johnson, 207 E. Franklin St., Mt. Sterling, IL (US) 62353; Craig Johnson, 207 E. Franklin St., Mt. Sterling, IL (US) 62353

( * ) Notice: Subject to any disclaimer, the term of this patent is extended or adjusted under 35 U.S.C. 154(b) by 0 days.

(21) Appl. No.: 09/795,128

(22) Filed: Mar. 1, 2001

(51) Int. Cl.[7] ..... A45D 29/00
(52) U.S. Cl. ..... 132/73; 15/209.1; 401/8
(58) Field of Search ..... 132/73, 73.5, 74.5, 132/75, 75.3, 75.6, 76.5, 320; 15/227, 104.94, 209.1, 210.1, 244.1; 401/6, 7, 8

(56) References Cited

U.S. PATENT DOCUMENTS 1,064,641 A * 6/1913 Halstead ..... 401/28
1,450,817 A * 4/1923 Porter ..... 401/8
2,098,966 A * 11/1937 Kingman ..... 401/8
2,539,029 A * 1/1951 Megill ..... 118/201
2,695,704 A * 11/1954 McGredy ..... 206/234
2,980,940 A * 4/1961 Crowe ..... 15/104.94
3,699,672 A * 10/1972 Sims ..... 36/7.7
3,798,698 A * 3/1974 Conklin, Jr. ..... 15/167.1
4,202,139 A * 5/1980 Hong et al. ..... 451/524
4,854,761 A * 8/1989 Smith et al. ..... 401/196
5,003,659 A * 4/1991 Paepke ..... 15/229.13
5,493,749 A * 2/1996 Zayas ..... 15/244.1
5,500,049 A * 3/1996 Kolinsky ..... 134/6
5,815,876 A * 10/1998 Overseth ..... 15/179

* cited by examiner

*Primary Examiner*—Nicholas D. Lucchesi
*Assistant Examiner*—David C. Comstock
(74) *Attorney, Agent, or Firm*—Patent & Trademark Services; Thomas Zack; Joseph H. McGlynn

(57) ABSTRACT

A coating removal device having two interrelated parts, one of the parts attaches to the user's fingers or hand and acts as a protective guard while the other part is a detachable, removable and disposable pad. One use for the device is to remove nail polish from nails.

5 Claims, 2 Drawing Sheets

POLISH REMOVER PAD HAVING PROTECTIVE RIM

BACKGROUND OF THE INVENTION

This invention relates to a pad having a finger guard wherein the pad may be used to apply a remover to an object such as nail polish remover to the coated nails of a user.

Kits and other devices used for personal care are well known and have been used for many years. In one such early invention, a nail polish remover kit has a jar and a saturated filler. Another prior art kit discloses a hand holder for receiving and supporting the fingers and hand during a manicure treatment.

Still another device disclosed is used to remove fingernail polish and covers the fingers of a user. In another invention a combined foot support and tray for holding grooming needs is disclosed. Still another invention discloses a tray for supporting the fingers and hand or foot during a manicure or pedicure treatment.

DESCRIPTION OF THE PRIOR ART

Kits and other devices used for personal care are well known as evidenced by the prior art. For example, U.S. Pat. No. 4,440,181 to Scherer a nail polish remover kit has a jar and a saturated filler is disclosed.

U.S. Pat. No. 4,585,017 to Trujillo discloses a hand holder for receiving and supporting the fingers and hand during a manicure treatment.

U.S. Pat. No. 5,027,839 to Appell disclosed is used to remove fingernail polish and covers the fingers of a user.

U.S. Pat. No. 5,579,545 to Beard discloses a a combined foot support and tray for holding grooming needs.

U.S. Pat. No. 5,842,483 to Timko discloses a tray for supporting the fingers and hand or foot during a manicure or pedicure treatment.

In the present invention a polish remover device consists of two parts, one of the parts attaches to the user's fingers or hand and has a protective guard while the other part is a detachable, removable and disposable pad all as will be detailed in the specification that follows hereafter.

SUMMARY OF THE INVENTION

This invention relates to a polish remover device having two interrelated parts, one of the parts attaches to the user's fingers or hand and acts as a protective guard while the other part is a detachable, removable and disposable pad.

It is the primary object of the present invention to provide for an improved guard and pad to apply coating removing materials.

Another object is to provide for such a combination in which the pad is removably attached to the guard and the guard has finger receiving members mounted to it.

These and other objects and advantages of the present invention will become apparent to readers from a consideration of the ensuing description and the accompanying drawings.

DESCRIPTION OF THE PREFERRED EMBODIMENT

Figure 1:
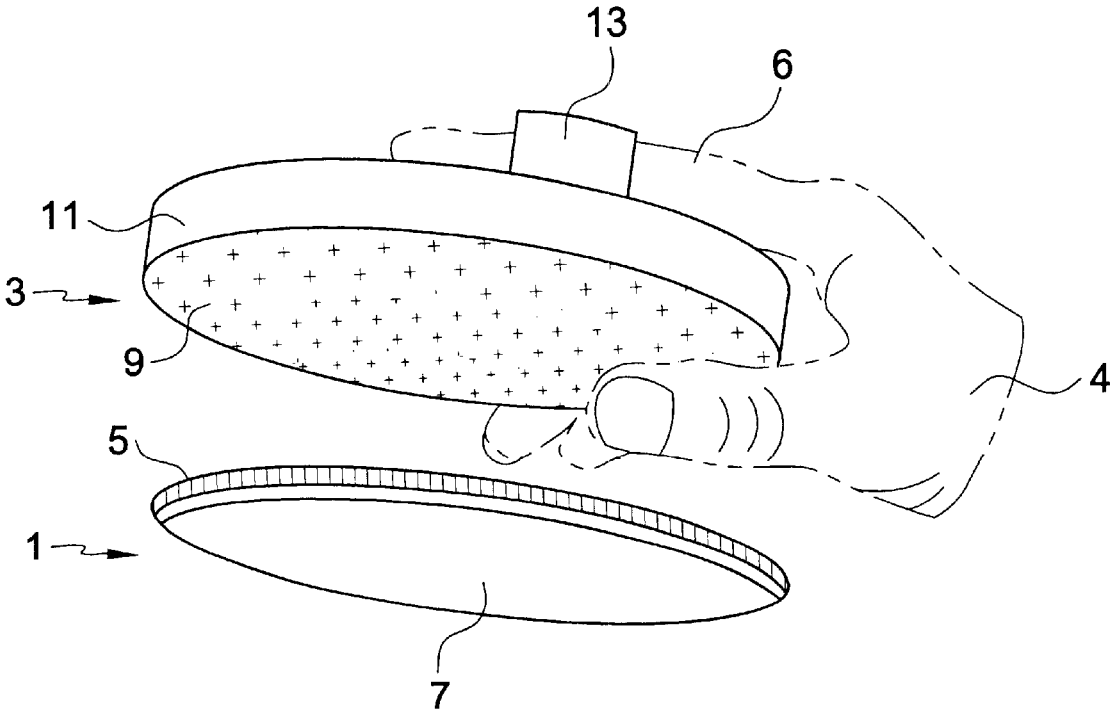
FIG. 1 is a perspective view of the present invention showing the removable pad detached from the guard.

FIG. 1 is a perspective view of the present invention showing the removable main pad 1 detached from the guard 3. The polish remover receiver main pad assembly 1 has an upper hook and loop 5 or VELCRO surface and a lower small pad surface 7. Both surfaces 1 and 3 are generally flat and they may be oval shaped. Facing towards the upper hook and loop 5 is another hook and loop surface 9 located on the lower surface of guard 3. The hook or the loops for each of these two surfaces 5 and 9 may be interchanged such that the hooks are on one surface while the loops are on the on the other surface. When the two facing surfaces, surfaces 5 and 9, one with hooks and the other with loops are pressed together the lower pad assembly 1 is held firmly and attached to the upper guard 3. By pulling on pad assembly 1 it may be detached from the guard 3.

Above the hook and loop surface 9 is a base oval shaped flat surface 11 which has two finger receiving straps, one of which 13 is partially shown, attached to the top surface of the base opposite the surface 9. The upper guard 3 is larger in facing area than the lower pad assembly 1 such that when attached there is a protective formed rim extending totally around the pad assembly. In use two of the user's fingers, like the middle and index fingers, would fit through the two upper loop straps fixed to the base 11 to allow for movement of the guard 3 and its attached pad assembly 1 together. In this figure one hand of a user 4, shown in dotted line format, has a finger 6 extending through one of the straps 13 and rests on the top surface of the base 11 with some fingers and the thumb depending from the sides of the base.

Figure 2:
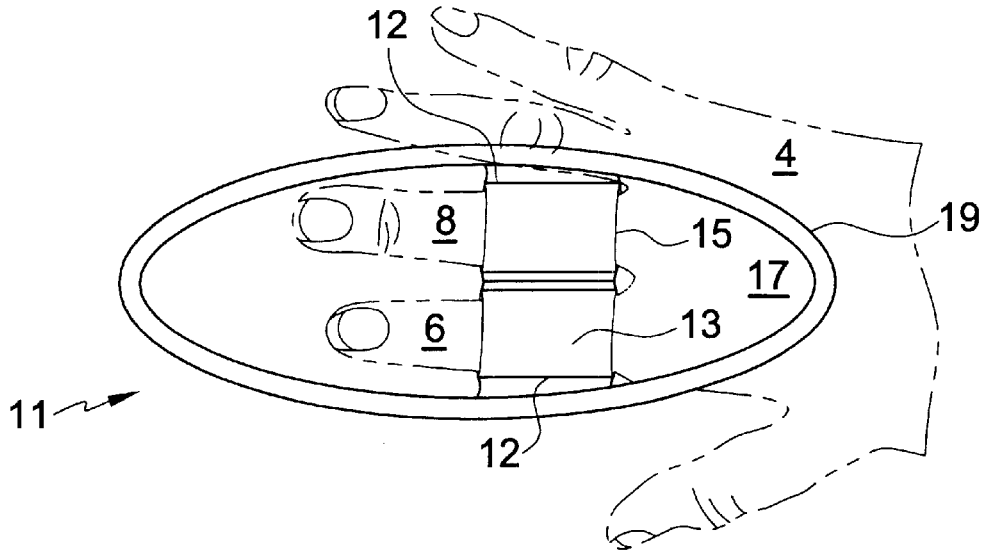
FIG. 2 is a top view of the guard in FIG. 1 with two fingers of the used strapped to the upper surface.

FIG. 2 is a top view of the guard 3 in FIG. 1 with two fingers of the used strapped to the upper surface of the base 11. Two adjustable loop straps 13 and 15 are fixed to the surface of the base and extend upwardly therefrom. These loops forming the straps may have their loop sized adjusted to take into consideration fingers of different thickness. One way to do this is to have hook and loop fastener surfaces at an overlapping split 12 of the straps to permit each loop to be split apart and then rejoined. Conventional buckled ends at the splits of the loops may be used for the same purpose. Extending around the flat top surface 17 is an upstanding rim 19 used to provide additional protection for the user from liquids on the attached lower pad 7. Two fingers 6 and 8 of the user, shown in dotted line format, extend through the two straps with the remaining thumb and other two fingers to the sides of the guard's base 11.

Figure 3:
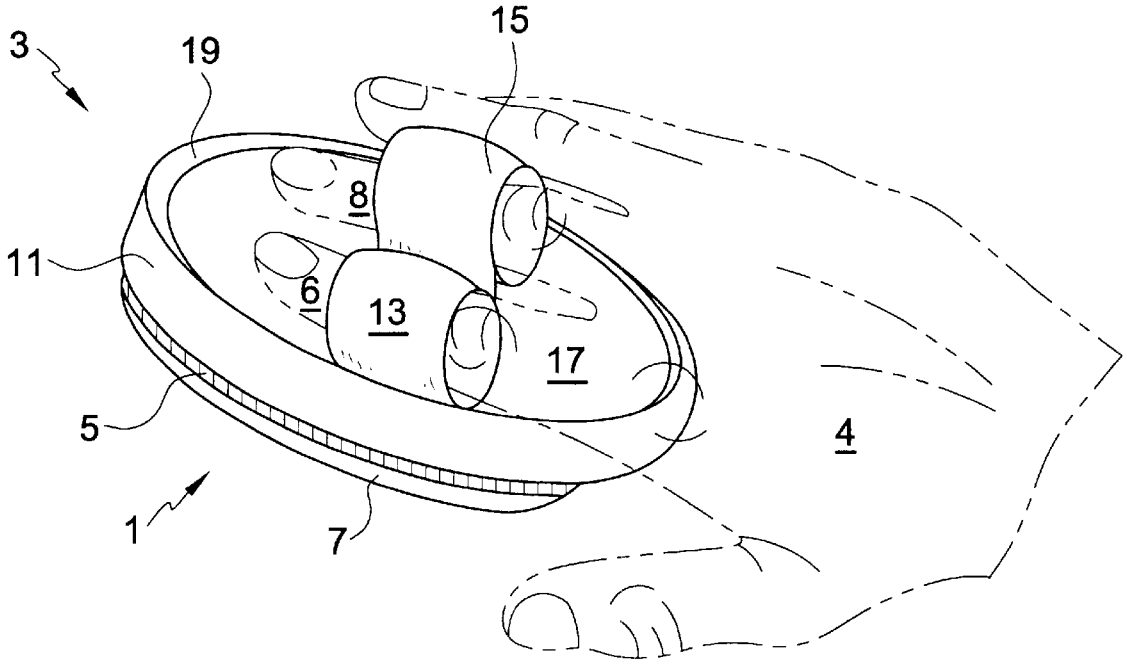
FIG. 3 is a perspective view of the present invention from a different angle than that of FIG. 1, showing the removable pad attached to the guard.

FIG. 3 is a perspective view of the present invention from a different angle than that of FIG. 1, showing the removable pad 1 attached to the finger/hand guard 3 by the two facing surfaces (5 and 9) made of hook and loop fasteners. The index finger and the middle finger of the user fit into and through the two loop straps 13 and 15. The upstanding rim 19 goes around the flat inner surface on the base 11 to protect the inserted fingers. On the lower part of base 11 is its mating hook or loop surface 9 (not shown) which faces the hook or loop surface 5 and is generally coextensive with it in size and shape. As seen in this figure, the lower pad assembly 1 is smaller in overall size or area than the guard 3 and is generally shaped the same as the upper engaged surface of the guard, in this case oval shaped.

Figure 4:
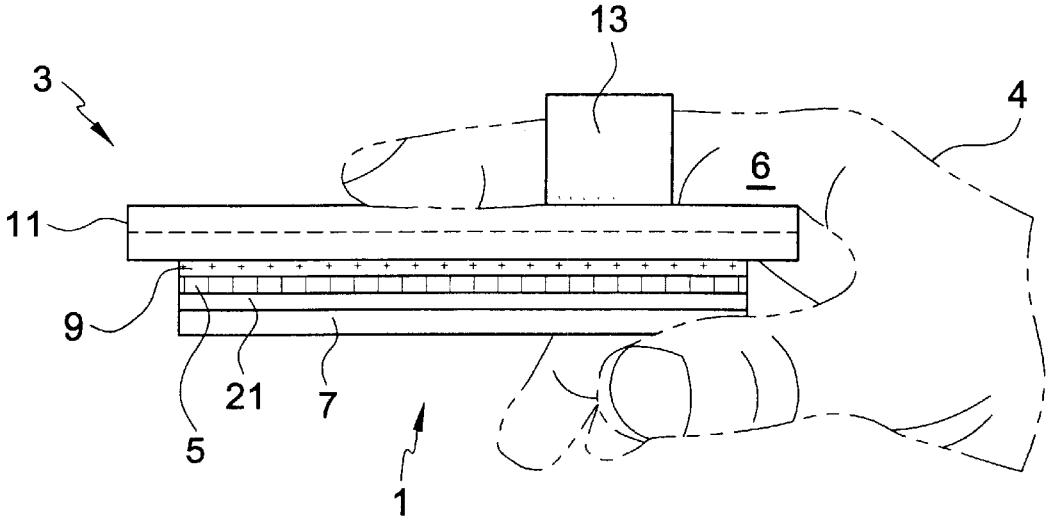
FIG. 4 is a side view of the guard and pad shown in FIG. 1.

FIG. 4 is a side view of the guard 3 and pad assembly 1 shown in FIG. 1. In this figure the near finger 6 goes through the loop strap 13 and rests on the top surface of the base 11. The upstanding rim 19 goes around the lower part of finger 6, and finger 8 in strap 15 directly behind, to protect them. Below the base of the guard 3 is the attached hook and loop surface 9 which engages hook or loop surface 5 of the detachable pad assembly 1. Forming part of the pad assembly 1 is a thin oval shaped base 21 located between the hook or loop surface 5 and the absorbent pad 7 that receives the covering removing material. Base 21 is attached to both pad 7 on one side and the hook and loop fastners on the other side. The smaller pad assembly 1 is completely surrounded on its top by the larger guard 3 and has the same general configuration.

One use of the main uses of the present invention is to protect the hand of a technician as she or he is applying a nail polish remover material on the pad 7 to remove a coating, nail polish, from the nails of another. The absorbent pad 7, like a cotton pad or foam, would contain the nail polish remover material while the guard 3 would prevent the typically solvent based remover from splashing onto the technician's hand. In one embodiment the top base 11 was a thin flat oval with a maximum width of 1.5 inches by a maximum length of 2.5 inches. The disposable and detachable pad assembly 1 is about 25 percent smaller in surface area than the guard 3 and have the same general shape. The shape of the guard and pad need not be oval and could vary as needed or desired as long as the desired function is accomplished. Various sizes and other shapes may also be used for these two components. Solvent resistant plastic materials, rubber and lint-free cotton on foam may be used to construct the different components. Clearly, other types of coating removal materials applied to the absorbent pad 7 may be used to remove a covering material and fall within the confines of this invention to provide for the same type of guard protection. For example, a paint thinner/removal solvent based material used to remove a covering of paint from a surface.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A device for removing polish, said device comprising:

a first part, said first part having a flat top surface and a bottom surface, said flat top surface of said first part having two finger receiving loops, each of said two finger receiving loops being fixed to the top surface of the first part, means for adjusting the lengths of the two finger receiving loops, an upstanding rim extending around said flat top surface of the first part to protect the fingers of a user when attached to the two finger receiving loops, said bottom surface having means for attaching said first part to a second part, said second part having a top surface and a bottom surface, and said top surface of said second part having means for cooperating with said means on said bottom surface of said first part for securing said first part to said second part.

2. The device as claimed in claim 1, wherein said means for adjusting the lengths of said two finger receiving loops comprise a split in each of said said loops.

3. The device claimed in claim 1, wherein said first part and said second part are both oval shaped, and said second part having a smaller surface area than said first part.

4. The combination as claimed in claim 1, wherein said second part includes a base, said base being made of a soft absorbent material, and said base having a covering material, said covering material being a nail polish removal material.

5. The device as claimed in claim 2, wherein said split divides each of said two finger loops into two parts, each of said two parts of the two finger loops being fixed to the flat top surface of the first part.

* * * * *